United States Patent [19]

Elfline

[11] Patent Number: 4,764,281

[45] Date of Patent: Aug. 16, 1988

[54] METHOD OF REMOVING RADIOACTIVE ISOTOPES OF HEAVY METALS

[75] Inventor: Geraldine S. Elfline, Morrison, Ill.

[73] Assignee: Iso-Clear Systems Corporation, Oak Ridge, Tenn.

[21] Appl. No.: 849,152

[22] Filed: Apr. 7, 1986

[51] Int. Cl.[4] ..... G21F 9/10

[52] U.S. Cl. ..... 210/668; 210/669; 210/682; 210/688; 210/721; 210/730; 210/912; 210/914; 423/11

[58] Field of Search ..... 210/668,669, 682, 688, 210/721, 730, 912–914; 423/6, 7, 11, 12

[56] References Cited

U.S. PATENT DOCUMENTS 1,059,531 4/1913 Ebler ..... 210/682
3,970,553 7/1976 Terajima et al. ..... 210/679
4,410,497 10/1983 Otto ..... 423/11

*Primary Examiner*—Ivars Cintins
*Attorney, Agent, or Firm*—Mason, Kolehmainen, Rathburn & Wyss

[57] ABSTRACT

A method for treating a radioactive metal-containing natural water or liquid such as a radioactive metal-containing wastewater stream, an oil containing one or more radioactive metals, or other nuclear metal-bearing liquid by contacting the radioactive heavy metal-containing liquid with a water-in-soluble carboxylated cellulose to separate the heavy metals from the liquid. The process has been found to be unexpectedly effective on radioactive wastewaters or any other liquid containing one or more radioactive heavy metal ions such as U, Ce, Sr, Ru, Ra, Np, Tc, as well as radioactive ions such as I.

16 Claims, No Drawings

METHOD OF REMOVING RADIOACTIVE ISOTOPES OF HEAVY METALS

FIELD OF THE INVENTION

The present invention is directed to a method for removing radioactive nuclear wastes from wastewater, oil or other liquids. This invention is especially useful in removing low levels of radiation, such as less than $1\times10^{10}$ Becquerels per liter, or disintegrations per second per liter. More particularly, the present invention is directed to a method for treating these radioactive heavy metal-containing liquids, such as liquids containing the radioactive nuclear isotopes of radium, uranium, cesium, strontium, ruthenium, neptunium, technetium, iodine and/or other elements, with a carboxymethylcellulose, particularly an insoluble metal carboxymethylcellulose, such as aluminum carboxymethylcellulose, to remove radioactive heavy metals therefrom as a part of and along with the solid carboxymethylcellulose.

BACKGROUND OF THE INVENTION

Federal, state and local governmental bodies reacting to constituent pressures have instituted a series of laws and regulations aimed at preventing the continued contamination of the environment. Heavy metals are generally defined as hazardous and, therefore, must be removed from industrial effluent streams. Once removed from these streams, the heavy metals-containing waste has been containerized and then disposed of in government-sanctioned landfills. These special landfills are now being more closely monitored thereby forcing alternative methods of disposal of these solid heavy metal wastes. It is toward both the clean-up of these effluent streams and discontinued pollution of soil and ground waters that the invention of this method is aimed.

Progressively stricter regulatory criteria have forced industry to drastically reduce the residual metal content in wastewater discharges. Obviously, regulations pertaining to wastes containing radioactive isotopes are among the most severe, and among the costliest with which to comply. Increased cost for disposal of any solid metal wastes have also forced industries to examine present treatment techniques and to demand more efficient and cost effective alternatives to those currently available.

The ability of conventional wastewater treatment methods to achieve the low levels of residual metals required by the higher standards for wastewater purity in many cases is marginal. Recent legislation has made the disposal of sludge material extremely difficult and expensive, with no near term solution to the sludge disposal problem being apparent.

Because of these problems, industry in general, and the nuclear reaction segments in particular, have been forced to consider alternative methods for heavy metals removal from wastewater streams. The major characteristics required in heavy metals removal from wastewater streams are: ability to reduce residual metal contents to extremely low levels (ultimately to the parts-per-billion range); production of minimal amounts of sludge; economical operation; production of effluent suitable for recycle to process operations; and ability for maximum retrofit into existing installations.

Some of these problems were addressed in an analysis of the processes used in treating drinking water for the removal of radioactive contaminants, and of the disposal of wastes generated by these processes in TREATMENT, WASTE MANAGEMENT AND COST FOR REMOVAL OF RADIOACTIVITY FROM DRINKING WATER, G. W. Reid and P. Lassovszky, Health Physics, 48 (1985) pp. 671–694. The alternative processes, including ion exchange, reverse osmosis or electrodialysis, lime and lime-soda softening, greensand, manganese fiber, coagulation techniques and activated alumina, were evaluated in terms of cost, efficiency, reliability, process control and feasibility for the removal of u, Ra, and Rn from water. Each of these processes has disadvantages requiring the continued search for a safe, effective method of radioactive metals removal with a minimum of waste product formation.

One of the more promising new alternative approaches that possesses the potential of fulfilling to a significant degree these desirable requirements for treating meal-bearing wastewaters is xanthate technology. A patent to John Hanway Jr. et al, U.S. Pat. No. 4,166,032, discloses the use of cellulose xanthate for heavy metals removal from wastewater streams. While cellulose xanthate is very effective for the removal of heavy metals from wastewater, the cellulose xanthate adds an amount of sludge equal to the dry weight of the cellulose xanthate added to the wastewater stream further increasing both the weight and volume of the sludge generated. Also, cellulose xanthate cannot be used successfully in a column through which a solution containing heavy metal ions is poured.

In accordance with the present invention, it has been found that one or more water-insoluble cation-exchange carboxylated cellulosics, such as an aluminum salt of carboxymethylcellulose, can remove radioactive heavy metal isotopes from liquids, such as nuclear fuel manufacturing wastewater streams, natural waters, and other wastewaters and nuclear-contaminated oils in new and unexpected proportions, leaving a substantially non-polluted solution or effluent capable of plant recycle or legal discharge. In addition, the resulting radioactive carboxymethylcellulose bed from the column can be easily treated using existing technology, producing a small volume, radioactive ceramic fiber. The overall radioactive waste is thus reduced in volume by several factors, allowing for easier and less expensive disposal.

It is known that insoluble cation-exchange forms of cellulose, such as carboxymethylcellulose, are effective in removing certain heavy metals such as Al, Cr, Sn, Pb, Fe, Cu, Ni and Zn from a wastewater, as disclosed in A SYSTEM OF ION-EXCHANGE CELLULOSES FOR THE PRODUCTION OF HIGH PURITY WATER, Horwath Zs, Journal of Chromatography, 102 (1974) pp. 409–412. However, such insoluble celluloses have not been used for removal of the radioactive isotopes of elements such as U, Cs, Sr, Ra, Ru, Rh, Np, Tc or I from waste streams. As disclosed in the Horwath article, the insoluble carboxymethylcellulose is disposed in a column in a sandwich-type arrangement with other forms of ion-exchange celluloses and the wastewater passed through the column, with the ion exchange celluloses acting as a filtering media for absorption of the heavy metals therein.

U.S. Pat. No. 4,260,740, assigned to Pfizer, Inc., also discloses that insoluble carboxylated cellulose is useful as an ion exchange material for removal of heavy metals from an industrial effluent and for precious metal recovery. The process disclosed in U.S. Pat. No. 4,260,740 teaches a reaction of cellulose with polycarboxylic acids followed by a hydrolysis step in dilute alkali at a pH of 8 to 11 to bind each polycarboxylic acid moiety to the cellulose and thereby increase the ion exchange capacity towards heavy metal ions.

U.S. Pat. No. 4,537,818 teaches the manufacture of thin free-standing metal oxide films by absorbing cations such as U, Zn, Nd, Ce, Th, Pr, Cr onto carboxymethylcellulose. The heavy metal-impregnated film is first heated in an inert atmosphere and then oxidized to form a carbonized metal oxide membrane useful as a nuclear acceleration target material.

SUMMARY OF THE INVENTION

In brief, the present invention is directed to a method for treating a radioactive metal-containing natural water or liquid such as a radioactive metal-containing wastewater stream, an oil containing one or more radioactive metals or other nuclear metal-bearing liquid. The process of the present invention has been found to be unexpectedly effective on radioactive wastewaters or any other liquid containing one or more radioactive heavy metal ions such as U, Ce, Sr, Ru, Ra, Np, Tc, as well as radioactive ions such as I. In accordance with the principles of the present invention, the radioactive heavy metal-containing liquid is contacted with a water-insoluble carboxylated cellulose to separate the heavy metals from the liquid.

Accordingly, an object of the present invention is to provide a method for treating a liquid containing one or more radioisotopes to cause removal in an unexpected large proportion of the radioisotopes therefrom.

Another object of the present invention is to provide a method for treating nuclear waste bearing water or other liquids with a water-insoluble form of a carboxylated cellulose for removal of the nuclear wastes therefrom.

Yet another object of the present invention is to provide a method for contacting a liquid containing one or more nuclear isotopes of a heavy metal, with an insoluble form of carboxymethylcellulose to remove a substantial portion of the nuclear isotopes for recycle of the treated liquid to an industrial process.

DETAILED DESCRIPTION OF THE PREFERRED EMBODIMENTS

In accordance with the principles of the present invention, residual radioisotope contents in the low parts-per-million range (and in fact often parts-per-billion) may be obtained by contacting the contaminated liquid with an insoluble form of a carboxylated cellulose, such as a carboxymethylcellulose, by flowing the liquid through a column containing the insoluble carboxylated cellulose.

Sodium carboxymethylcellulose is available commercially, however, due to its water solubility, it is unsuitable for use in the present invention. The aluminum salt was used in the initial testing due to the ease of synthesis of the aluminum salt of carboxymethylcellulose. By way of example, an insoluble form of carboxymethylcellulose is obtained by mixing a solution of sodium carboxymethylcellulose with a solution of aluminum sulfate to produce an insoluble aluminum carboxymethylcellulose. Similarly, insoluble forms of carboxylated cellulose may be obtained by mixing the soluble form with ions other than aluminum ions, such as chromium ion ($Cr^{+3}$), e.g., in the form of chromium nitrate or chromium chloride, to produce chromium carboxymethylcellulose.

In accordance with an important feature of the present invention, nuclear or radioactive metals are removed from solution using an insoluble carboxylated cellulose by flowing the contaminated liquid solution through a bed of an insoluble form of carboxylated cellulose. The insoluble carboxylated cellulose is capable of removing unexpected quantities of nuclear or radioactive metals from liquids, for example radium, radon, molybdenum, praseodymium, polonium, lead, astatine, bismuth, thallium, mercury, zirconium, barium, promethium, uranium, cesium, strontium, ruthenium, neptunium, technetium, iodine, thorium, niobium, cerium, rubidium, palladium, curium, plutonium, tellurium, samarium, americium, protactinium, lanthanum, indium, neodymium, lutetium, rhodium or mixtures thereof and is particularly effective for removal of U, Ce, Sr, Ru, Ra, Np, Tc and other radioactive ions, such as I. In some cases a pre-treatment of the contaminated liquid is desirable to assist in removing a non-radioactive ions, molecules or complexes from the solution. For example, pre-treatment with hypochlorite, chlorine gas, ozone or other oxidizing agent is used for the destruction of ions such as cyanide. Additionally, other reagents may be used with the water-insoluble carboxylated cellulose to aid directly or indirectly in radioactive metal removal. It has been found that ammonium-complexed metal solutions are more amenable to treatment if the solution is first treated with sodium diethyldithiocarbamate. The carbamate itself does not remove the metal, but, through a catalytic effect or the formation of a new metal complex, diethyldithiocarbamate addition leads to much faster metal removal as the solution passes through the column. Treatment of a radioactive metal-bearing liquid may also involve the adjustment of the pH of the solution to facilitate the reaction or to comply with minicipal sewer requirements.

In accordance with an important feature of the present invention, contact of the liquid to be treated with the insoluble carboxylated cellulose, particularly carboxymethylcellulose, creates an insoluble, radioisotope-laden carboxylated cellulose material which can be disposed of as a small volume of material, either by direct burial because of its biodegradability or calcination at 400° to 500° C. to fuse the material into small microscopic ceramic fibrils rather than the usual entrainable fine powder, which thereafter can be buried in an approved EPA landfill.

Initial evaluation of water-insoluble carboxylated cellulose for possible use in removing radioactive metals from nuclear waste streams initially centered on a slurry treatment technique. However, it was realized that a vertical column loaded with water-insoluble aluminum carboxymethylcellulose produced more efficient radioactive metals removal, thus tests were conducted using this technique. A disposable, plastic cartridge, preloaded with an insoluble carboxylated cellulose could easily retrofit into the existing equipment of the user, and is ideally suitable for the above-mentioned calcination and burial after loading to capacity with a radioactive metal.

Five separate tests were conducted and quantified by beta and alpha counting of dried aliquots of the feed and effluent solutions. Four of these tests were performed using actual samples taken from a low-level waste stream. The fifth was performed on a laboratory prepared $^{235}U$ solution. These results are shown in Table 1 and are expressed in Becquerels per liter. (One Becquerel=one disintegration per second.)

TABLE I

| Sample Number | | ACTIVE TESTS Diversion Box Samples Beta-Gamma BQ/L | Alpha BQ/L | pH |
|---|---|---|---|---|
| 1 | Feed | 800 ± 30 | 24 ± 9 | 6 |
| | Effluent | 24 ± 6 | 4.5 ± 4.5 | 6 |
| 2 | Feed | 650 ± 30 | 20 ± 8 | 6 |
| | Effluent | 28 ± 7 | 4 ± 4 | 6 |
| 3 | Feed | 1400 ± 100 | 53 ± 13 | 8 |
| | Effluent | 410 ± 20 | 20 ± 8 | 8 |
| 4 | Feed | 1100 ± 100 | 50 ± 3 | 6 |
| | Effluent | 16 ± 3 | 10 ± 2 | 6 |
| | | $^{235}UO_2(NO_3)_2$ pH 3 Alpha | | |
| 5 | Feed | $1.78 \times 10^9$ BQ/L | | |
| | Effluent | $3 \times 10^3$ BQ/L | | |

In addition, seven other qualitative tests of the affinity of the insoluble aluminum carboxymethylcellulose for different elements, which occur in nuclear wastes, were conducted. Each test was conducted through 200 ml bed volume contained in a 1 inch diameter glass container having a bed height of 15.5 inches. The flow conditions and influent stream contaminants are shown in Table II:

TABLE II

| Test Conditions: |
|---|
| Flow Rate: 200 ml/min |
| Total Thru-put: 1000 ml (5 bed volumes) |
| Sampled: last 100 ml |
| Bed washed with 1000 ml distilled water, before loading |
| Qualitative |
| 1. Iodine pH 6 1 mg/ml |
| 2. Uranium pH 6 0.5 mg/ml |
| 3. Ruthenium pH 8 2 mg/ml |
| 4. Rhenium (for Tc) pH 6 1 mg/ml |
| 5. Cesium pH 6 1 mg/ml |
| 6. Strontium pH 6 1 mg/ml |
| 7. Rare-Earth Mixture pH 5 1 mg/ml |

The feed solutions prepared for these determinations consisted only of distilled water and the element of interest in a water-soluble form. The solution pH was adjusted with sodium hydroxide to the value shown. In each test a sample of the feed and effluent was treated by adding a particular reagent, which is known to precipitate the subject element present. The two samples were then compared visually to ascertain degree removal and thru-flow. In all tests except those for strontium, rare earths, and rhenium (which was substituted for technetium), there was definite evidence of removal being denoted by complete absence of precipitation in the effluents.

The ability of an insoluble form of carboxymethylcellulose to remove low levels of radioactive isotopes from naturally occurring waters also is quite unexpected. Many of the water systems in the West Central Illinois region draw water from deep wells which contain radioactive radium 226 and 228 in combined concentrations upwards of 30 pico-curies per liter. To remove these low level radioactive isotopes, a test column with a diameter to height ratio of 1:6, and containing a settled volume of 100 cubic centimeters of aluminum carboxymethylcellulose was prepared. Through this column bed, a one liter volume of tap water (10 bed volumes) containing a 226 radium concentration of $1.56 \times 10^5$ disintegrations per second per liter (d/s/L) (Bequerels per liter) or $4.22 \times 10^6$ pico-curies per liter was passed. The pH of the column feed was 7.0 and the flow rate was 100 cc/min or one bed volume per minute. The total one liter effluent was collected, mixed, and sampled. Immediate radio-assay of this sample indicated a level of $2.26 \times 10^4$ d/s/L of *gross* activity or $6.11 \times 10^5$ pico-curies per liter (85.5% activity removal). After six hours the count rate of the effluent sample had dropped by 10%; after 24 hours the count rate was reduced by 22%.

The sequence of decay of 226 radium causes the radio-assay of this element to become very complex by ordinary counting techniques. 226 Radium undergoes nine (9) sequential elemental changes before decaying to stable 204 lead. Each of these transitions produces radioactivity. 222 Radon, the first daughter of 226 radium, is an inert gas and very soluble in water. Being chemically inert, radon passes through the aluminum carboxymethylcellulose bed with the effluent, and continues through the normal decay mode. In consideration of the relatively rapid decline in the count rate of the effluent sample, it is believed that the bulk of the activity in the effluent is due to the decay daughters of carried-thru radon, which can be substantiated by long term counting. It is obvious that no appreciable amount of 226 radium can be present in a solution that decays 22% in 24 hours since the half-life of 226 radium is 1622 years. While longer term counting is required to accurately quantify this experiment, the initial results justify the conclusion of substantial reduction of naturally occurring radioactivity from a water source.

In accordance with an important feature of the present invention it has been found that aluminum carboxymethylcellulose may be coupled with other radioactive metal removal techniques to produce a synergistic removal of the radioactive contaminants from water. For example, manganese dioxide, known as an adsorber of metal ions, can be combined with aluminum carboxymethylcellulose to provide an adduct unexpectedly capable of removing substantially all the radioactivity from a water solution containing radium in equilibrium with its decay daughters.

EXAMPLE 1

Aluminum carboxymethylcellulose was prepared by dissolving 100 grams of hydrated aluminum nitrate in two liters of water, heating the solution to 90° C., then, with good agitation, slowly adding 25 grams of sodium carboxymethylcellulose. After the addition of sodium carboxymethylcellulose, agitation was continued until the mixture cooled, then the precipitated aluminum carboxymethylcellulose was filtered off and washed. The aluminum carboxymethylcellulose was allowed to air dry, and was stored.

EXAMPLE 2

550 milliliters of a solution containing 250 millgrans of Uranium as U 235, 20 milligrams of Neptunium as Np 237 and 5 milligrams of Technetium as Tc 99 was passed through a one inch column containing 150 milliliter volume of the previously prepared aluminum carboxymethylcellulose. The separation of these metals from the solution were measured as removal of alpha and beta particles, with 100% of all alpha particles being removed and 99.6% of all beta particles being removed.

EXAMPLE 3

Aluminum carboxymethylcellulose was saturated with manganese dioxide. The adduct was placed in a column, and was used to remove radioactive radium and its decay daughters according to the following procedure:

Column diameter—1 in.
Bed volume—60 cc
Flow rate—30 cc/min. (avg.)
Total feed—600 cc (10 bed volumes)
pH—7.3
Feed activity (gross alpha - Radium and daughters in equilibrium). $6.723\times10^4$ disintegrations per second per liter (Becquerels per liter)

Test samples from 3–200 cc successive collections of effluent:

1st 200 cc through O-d/s/l
2nd 200 cc through $1.90\times10^2$ d/s/l=0.28%
3rd 200 cc through O d/s/l The count in the second sample represents 3.8 counts per minute, per cc, above background count rate of the instrument (3 per minute) - for minimal accuracy, the sample count rate should be at least 50 times the background, thus the reading in this test is insignificant.

It should be understood that the present disclosure has been made only by way of preferred embodiment and that numerous changes in details of construction, combination and arrangement of parts may be resorted to without departing from the spirit and scope of the invention as hereinunder claimed.

What is claimed and desired to be secured by Letters Patent of the United States is:

1. A method of treating a heavy metal radioisotope-bearing liquid to remove a substantial portion of the metal radioisotope metals therefrom without substantial sludge formation comprising:

contacting said liquid with a water-insoluble carboxylated cellulose in an amount sufficient to cause precipitation of a substantial portion of the heavy metal radioisotope in the liquid.

2. The method of claim 1 wherein the water-insoluble carboxylated cellulose is a salt of carboxymethylcellulose.

3. The method of claim 2 wherein the water-insoluble salt of carboxymethylcellulose is aluminum carboxymethylcellulose or chromium carboxymethylcellulose.

4. The method of claim 3 wherein the water-insoluble salt of carboxymethylcellulose is aluminum carboxymethylcellulose.

5. The method of claim 1 wherein the metal precipitated from said liquid is a radioactive metal selected from the group consisting of radium, radon, rhenium, molybdenum, praseodymium, polonium, lead, astatine, bismuth, thallium, mercury, zirconium, barium, promethium, uranium, cesium, strontium, ruthenium, neptunium, technetium, iodine, thorium, niobium, cerium, rubidium, palladium, curium, plutonium, tellurium, samarium, americium, protactinium, lanthanum, indium, neodymium, lutetium, rhodium or mixtures thereof.

6. The method of claim 5 wherein the metal precipitated from said liquid comprises radium, uranium, cesium, stontium, ruthenium, rhenium, neptunium, technetium or rhodium.

7. The method of claim 1 wherein the said liquid includes an aqueous liquid.

8. The method of claim 7 wherein the said aqueous liquid comprises natural waters, wastewaters, manufacturing effluents, or water-containing mixtures.

9. The method of claim 7 including adjusting the pH of said liquid above 6.0 and below 9.0 before contacting said liquid with the insoluble carboxylated cellulose.

10. The method of claim 9 wherein the insoluble carboxylated cellulose is a salt of carboxymethylcellulose.

11. The method of claim 1 further comprising initially treating said liquid with an oxidizing agent to destroy one or more interfering ions.

12. The method of claim 11 wherein said oxidizing agent is selected from the group consisting of ozone ($O_3$), chlorine gas ($Cl_2$) and hypochlorite ion ($OCl^-$).

13. The method of claim 11 wherein said interfering ion is cyanide ($CN^-$).

14. A method of treating a heavy metal radioisotope-bearing liquid containing a non-aqueous liquid, to remove a substantial portion of the metal radioisotope metals therefrom without substantial sludge formation comprising:

contacting said liquid with a water-insoluble carboxylated cellulose in an amount sufficient to cause precipitation of a substantial portion of the heavy metal radioisotope in the liquid.

15. The method of claim 14 wherein the said non-aqueous liquid comprises oil, petroleum distillates or lubricants.

16. A method of treating a heavy metal radioisotope-bearing liquid to remove a substantial portion of the metal radioisotope metals therefrom without substantial sludge formation comprising:

contacting said liquid with a water-insoluble carboxylated cellulose in an amount sufficient to cause precipitation of a substantial portion of the heavy metal radioisotope in the liquid; and adding sodium diethyldithiocarbamate to said liquid in an amount sufficient to reduce precipitation time.

* * * * *